US009340385B2

(12) United States Patent
Deno

(10) Patent No.: US 9,340,385 B2
(45) Date of Patent: May 17, 2016

(54) SKEW CORRECTION APPARATUS AND IMAGE FORMING APPARATUS HAVING A CONTROL UNIT TO CONTROL ROLLERS

(71) Applicant: CANON KABUSHIKI KAISHA, Tokyo (JP)

(72) Inventor: Kohei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/857,426

(22) Filed: Apr. 5, 2013

(65) Prior Publication Data

US 2013/0264767 A1 Oct. 10, 2013

(30) Foreign Application Priority Data

Apr. 9, 2012 (JP) ..... 2012-088471

(51) Int. Cl.

| | |
|---|---|
| ***B65H 9/00*** | (2006.01) |
| ***B65H 9/06*** | (2006.01) |
| ***B65H 1/26*** | (2006.01) |
| ***B65H 5/06*** | (2006.01) |

(52) U.S. Cl.

CPC ..... *B65H 9/00* (2013.01); *B65H 1/266* (2013.01); *B65H 5/062* (2013.01); *B65H 9/006* (2013.01); *B65H 9/06* (2013.01); *B65H 2404/144* (2013.01); *B65H 2404/6111* (2013.01); *B65H 2511/10* (2013.01); *B65H 2511/20* (2013.01); *B65H 2801/06* (2013.01)

(58) Field of Classification Search

CPC ..... B65H 5/064; B65H 9/006; B65H 9/106; B65H 9/14; B65H 2301/331; B65H 2511/216; B65H 2551/10; B65H 2601/272

USPC ..... 271/228, 242, 246, 273

See application file for complete search history.

(56) References Cited

U.S. PATENT DOCUMENTS

| | | | | |
|---|---|---|---|---|
| 6,059,285 | A * | 5/2000 | Suga et al. | 271/228 |
| 7,540,496 | B2 * | 6/2009 | Fukushima | B65H 9/002 271/253 |
| 8,213,851 | B2 * | 7/2012 | Shoji et al. | 399/395 |
| 8,770,581 | B2 * | 7/2014 | Deno | 271/228 |
| 9,045,296 | B2 * | 6/2015 | Matsumoto | |
| 2015/0108706 | A1 * | 4/2015 | Watanabe et al. | 271/3.18 |
| 2015/0151939 | A1 * | 6/2015 | Muneyasu et al. | 9/2 |

FOREIGN PATENT DOCUMENTS

| | | | |
|---|---|---|---|
| JP | S64-014749 | U | 1/1989 |
| JP | 6-345294 | A | 12/1994 |
| JP | 06345294 | A * | 12/1994 |
| JP | 2007-106572 | A | 4/2007 |
| JP | 2008-050069 | A | 3/2008 |

* cited by examiner

*Primary Examiner* — Gerald McClain

(74) *Attorney, Agent, or Firm* — Canon U.S.A., Inc. IP Division

(57) ABSTRACT

A skew correction apparatus includes a first roller pair configured to nip a sheet to convey the sheet, a second roller pair provided upstream of the first roller pair and configured to nip the sheet and convey the sheet, a contact portion provided downstream of the first roller pair and configured to come in contact with a leading edge of the sheet conveyed with the first roller pair to correct a skew of the sheet, and a separation mechanism configured to set the second roller pair to a separated state before the skew of the sheet conveyed downstream with the first roller pair is corrected.

8 Claims, 10 Drawing Sheets

FIG. 8

| | SHEET WIDTH mm | CLASSIFIED BY GRAMMAGE | | |
|---|---|---|---|---|
| | | 52–180 g/m² | 181–256 g/m² | 257–325 g/m² |
| WHETHER TO SET SECOND ROLLER PAIR TO SEPARATED STATE | 100 mm ~ 209 mm | YES | YES | YES |
| | 210 mm ~ 330.2 mm | YES | YES | NO |

SKEW CORRECTION APPARATUS AND IMAGE FORMING APPARATUS HAVING A CONTROL UNIT TO CONTROL ROLLERS

BACKGROUND OF THE INVENTION

1. Field of the Invention

Aspects of the present invention generally relate to a skew correction apparatus for correcting a skew of a sheet and an image forming apparatus including the skew correction apparatus.

2. Description of the Related Art

Known image forming apparatuses for forming an image on a sheet are provided with, to form the image without skew with respect to the sheet, a skew correction apparatus for correcting the skew of sheet conveyed to an image formation unit.

Generally, in the skew correction apparatuses, on a conveyance path between a sheet feeding unit for feeding a sheet and an image forming unit, registration rollers and a shutter are provided upstream of the image forming unit. The sheet skew correction operation with the registration roller pair and the shutter will be described with reference to Japanese Patent Application Laid-Open No. 6-345294. At the upstream side of the registration roller pair and the shutter, a roller pair (hereinafter, referred to as an upstream roller pair) is provided. The upstream roller pair nips and conveys the sheet fed from the sheet feeding unit toward the registration roller pair and the shutter. The leading edge of the sheet is pressed against the contact portion such as the registration rollers and the shutter to correct the skew of the leading edge portion of the sheet.

In the skew correction apparatus discussed in Japanese Patent Application Laid-Open No. 6-345294, an upstream roller pair nips and conveys the sheet such that the leading edge of the sheet comes in contact with the nip portion of the registration roller pair to form a loop. By the operation, the leading edge of the sheet is arranged along the nip portion and the skew of the sheet is corrected. In other words, between the registration roller pair and the upstream roller pair, a loop of a desired size of the sheet is formed such that the leading edge of the sheet and the shaft line of the registration roller pair become parallel to each other, and the skew of the leading edge portion of the sheet is corrected.

However, nowadays, image forming apparatuses are desirable to perform image formation on various types of sheet having different size, basis weight, or glossiness. To perform the skew correction on such various types of sheet, the known skew correction apparatuses have room for improvement.

In correcting a skew of sheet by making the leading edge of the sheet conveyed with the upper roller pair come in contact with the contact portion to form a loop of the sheet, a force to return to the original state (plane state) (hereinafter, referred to as loop reaction force) acts on the sheet having the formed loop. In a case of a sheet having a relatively large basis weight, the loop reaction force is larger. As a result, before a loop of a desired size is formed such that the leading edge of the sheet become parallel to the shaft line of the registration roller pair, the sheet slips at the upper roller pair.

While the sheet is slipping at the upper roller pair, if the sheet turns such that the leading edge of the sheet becomes parallel to the shaft line of the registration roller pair, the skew of the sheet is corrected. However, if the sheet is nipped with the upper roller pair and a roller pair located further upstream of the upper roller pair, the turning performance of the sheet is affected. As a result of the effect on the turning performance of the sheet, the leading edge of the sheet remains skewed with respect to the shaft line of the registration roller pair. This decreases the sheet skew correction performance.

The decrease in the sheet skew correction performance causes improper image formation on the sheet, resulting in image failure.

SUMMARY OF THE INVENTION

Aspects of the present invention generally relate to a skew correction apparatus having an increased performance for correcting sheet skew.

According to an aspect of the present invention, a skew correction apparatus includes a first roller pair configured to nip a sheet to convey the sheet, a second roller pair provided upstream of the first roller pair and configured to nip the sheet to convey the sheet, a contact portion provided downstream of the first roller pair and configured to come in contact with a leading edge of the sheet conveyed with the first roller pair to correct a skew of the sheet, and a separation mechanism configured to set the second roller pair to a separated state before the skew of the sheet conveyed downstream with the first roller pair is corrected.

According to exemplary embodiments, before a skew of a sheet conveyed downstream with a first roller pair is corrected, a separation mechanism sets a second roller pair provided upstream of the first roller pair to a separated state. This prevents the second roller pair from affecting the turning operation of the sheet. Consequently, the sheet skew correction performance in the skew correction apparatus can be increased.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 8 is a table showing whether to separate a second lower roller from a second upper roller according to the first exemplary embodiment.

DESCRIPTION OF THE EMBODIMENTS

Various exemplary embodiments, features, and aspects of the invention will be described in detail below with reference to the drawings.

Figure 9:
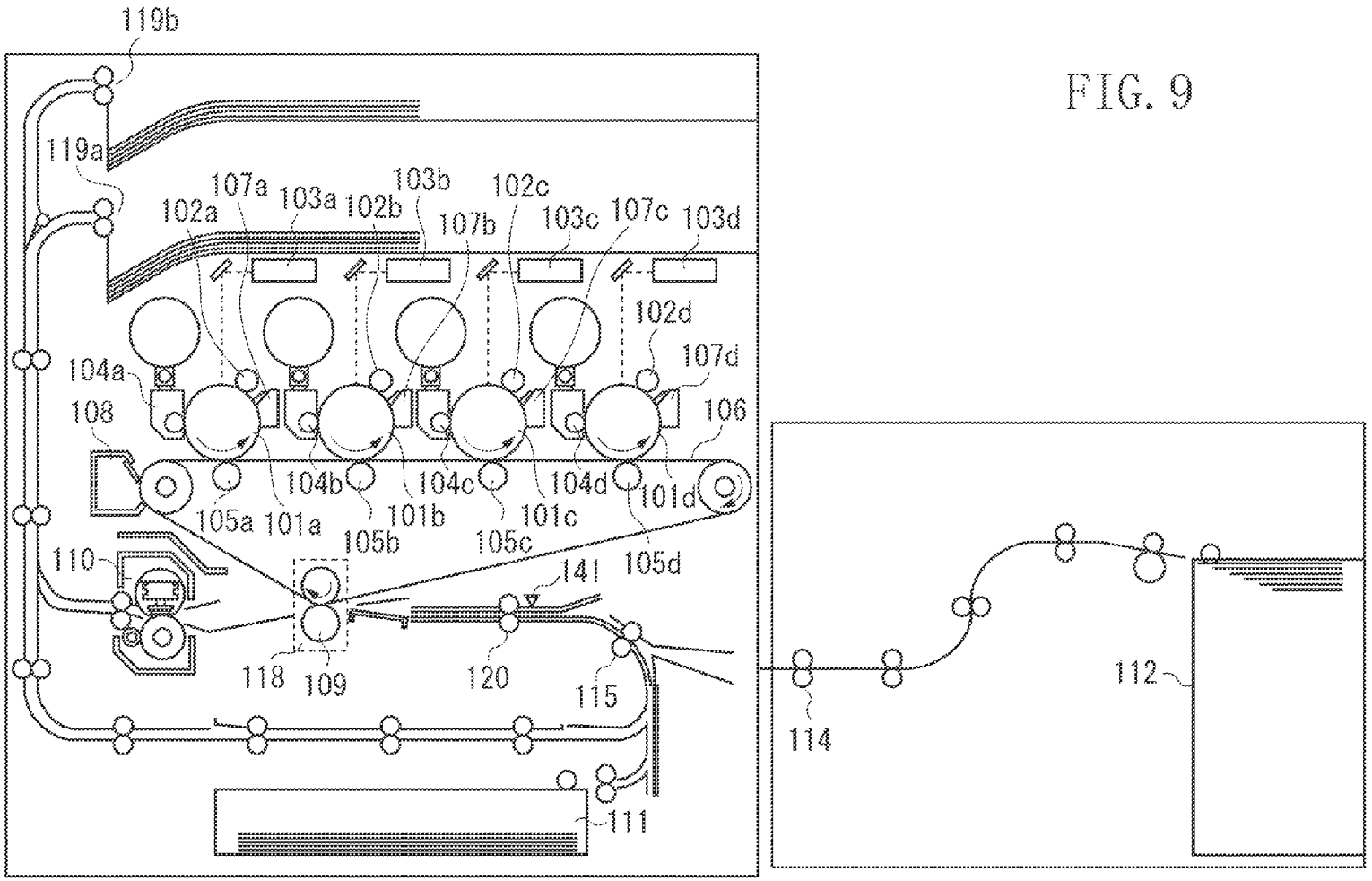
FIG. 9 illustrates an image forming apparatus to which the skew correction apparatus according to the exemplary embodiments is applied.

FIG. 9 is a cross-sectional view schematically illustrating a color digital printer that serves as an image forming apparatus to which a skew correction apparatus according to an exemplary embodiment.

First, an image forming unit is described. The surfaces of four photosensitive drums 101*a* to 101*d* are uniformly charged with discharging rollers 102*a* to 102*d*, respectively. To each of laser scanners 103*a* to 103*d*, image signals of yellow (Y), magenta (M), cyan (C), and black (B) are input. According to the image signals, the drum surfaces are irradiated with laser beams, the electric charge is neutralized, and latent images are formed.

The latent images formed on the photosensitive drums are each developed with toner of yellow, magenta, cyan, and black by development units 104*a* to 104*d*. The toner developed on the individual photosensitive drums is sequentially transferred onto an intermediate transfer belt 106 that serves as an endless belt-shaped image bearing member with primary transfer rollers 105*a* to 105*d*. On the intermediate transfer belt 106, a full-color toner image is formed.

A sheet fed from a sheet feeding cassette 111 or a sheet feeding deck 112 that stores sheets is conveyed toward a registration roller pair 120 with sheet feeding rollers. The toner image on the intermediate transfer belt 106 is controlled such that no deviation is generated between the sheet conveyed with the registration roller pair 120 and the image. The toner image is transferred onto the sheet with secondary transfer rollers 109. The toner image is heated and pressed with a fixing device 110 and fixed onto the sheet. The sheet is discharged from a discharge unit 119*a* or 119*b* to the outside of the apparatus.

An operation unit 200 (illustrated in FIG. 7) provided in the image forming apparatus is set such that users can input various kinds of sheet information (such as size information, basis weight information, information about surface properties, and the like) to a control unit described below. Further, a computer 201 connected via a network is set such that various kinds of sheet information can be input to the control unit described below.

The sheet feeding cassette 111 and the sheet feeding deck 112 include a size detection mechanism 130 for detecting the size of stored sheets and notifies the control unit in the image forming apparatus of the detected size. The size detection mechanism 130 includes a size detection lever that slides and contacts a side regulating plate for regulating the position of the sheet in the width direction. The side detection lever can rotate in conjunction with the side regulating plate.

The size detection mechanism 130 also includes a plurality of sensors and switches in an attachment portion in the apparatus body to which the paper feeding cassette is to be attached. The sensors or switches are provided at positions corresponding to the size detection lever. When the user moves the side regulation plate to adjust the plate to the side end portion of the sheet, the size detection lever rotates in conjunction with the movement. When the sheet feeding cassette is attached to the image forming apparatus, the size detection lever selectively turns on or off detection elements of the sensors or switches disposed in the attachment portion in the apparatus body. According to the operation, signals of different patterns are sent from the sensors or switches to the image forming apparatus body. Based on the signals, the information processing apparatus body can identify the size of the sheet stored in the sheet feeding cassette.

The side regulation plate can be moved to be adjusted to the side end portion of the sheet. With the structure, the sheet positioning in the width direction can be adjusted to the image forming unit. In addition, the side regulation plate is effective to prevent sheet skew generated during the sheet feeding operation or generated at the conveyance rollers provided downstream of the sheet feeding rollers. In actual operations, however, due to a small gap between the side regulation plate and the sheet, a skew of the sheet may be generated. In another case, the sheet conveyed from the sheet conveyance unit may generate a skew during the sheet conveyance operation.

To solve the problems, the image forming apparatus according to the exemplary embodiment is provided with a skew correction apparatus. The skew correction apparatus allows the leading edge of the conveyed sheet to come in contact with the nip portion of the stopped registration roller pair 120. By forming a loop of the sheet to adjust the leading edge of the sheet along the nip portion, the skew correction apparatus can correct a skew of the sheet. In this operation, the amount of the formed loop of the sheet is adjusted in such a manner that, after the sheet has passed a registration sensor 141, a first roller pair 115 disposed upstream of the registration roller pair 120 feeds the sheet by a predetermined amount.

Next, a skew correction apparatus according to a first exemplary embodiment is described.

Figure 1:
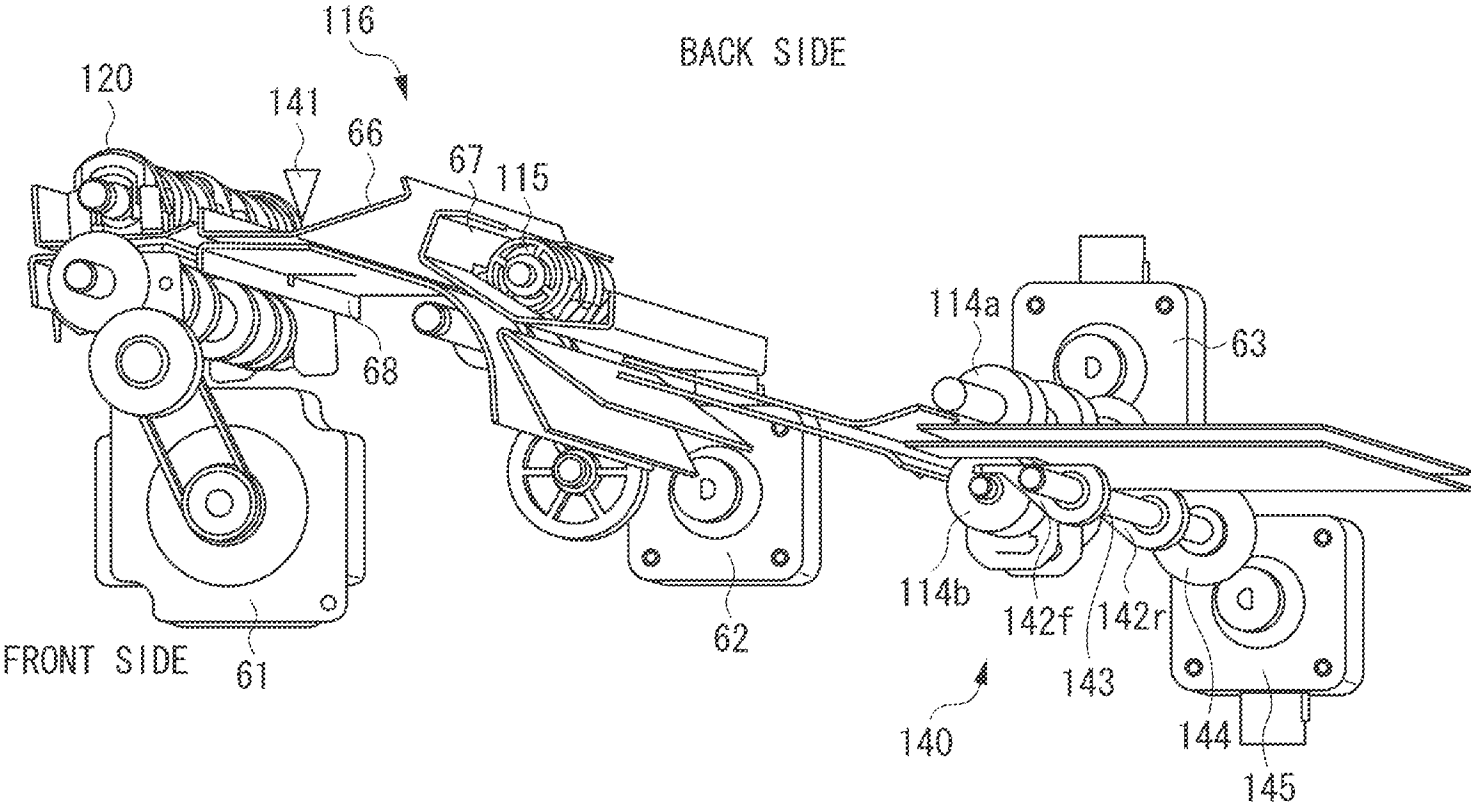
FIG. 1 illustrates a skew correction apparatus according to a first exemplary embodiment.

FIG. 1 is a perspective view illustrating a skew correction apparatus 116 according to the first exemplary embodiment. The skew correction apparatus 116 is provided in the conveyance path between the sheet feeding cassette 111 or the sheet feeding deck 112 and the image forming unit.

The first roller pair (first upstream roller pair) 115 provided in the conveyance path includes a first upper roller 115*a* and a first lower roller 115*b* disposed opposite to the first upper roller 115*a*. The first upper roller 115*a* includes a roller bearing made of polyacetal (POM). The first lower roller 115*b* is a rubber roller. The first upper roller 115*a* is swingably supported with a lever, or the like and is pressed and contacted with the first lower roller 115*b* by elastic force of a spring (not illustrated).

The second roller pair (second upstream roller pair) 114 provided upstream of the first roller pair 115 includes, similarly to the first roller pair 115, a second upper roller 114*a* and a second lower roller 114*b* disposed opposite to the second upper roller 114*a*. The second upper roller 114*a* is a rubber roller. The second lower roller 114*b* includes a roller bearing made of polyacetal (POM). The second lower roller 114*b* is swingably supported with a lever, or the like, and is pressed and contacted with the second upper roller 114*a* by elastic force of a spring (not illustrated).

At a position downstream of the first roller pair 115, the registration roller pair 120 is provided. The registration roller pair 120 includes an upper roller 120*a* and a lower roller 120*b*. In the exemplary embodiment, the nip portion formed by the upper roller 120*a* and the lower roller 120*b* is a contact portion with which the leading edge of a conveyed sheet comes in contact. The leading edge of the sheet comes in contact along the nip portion of the upper roller 120*a* and the lower roller 120*b*, thereby correcting a skew of the sheet. The upper roller 120*a* of the registration roller pair 120 includes a roller bearing made of polyacetal (POM), and the lower roller 120*b* is a rubber roller. The upper roller 120*a* is disposed opposite to the lower roller 120*b*. The upper roller 120*a* is swingably supported with a lever, or the like, and the upper roller 120*a* is pressed and contacted with the lower roller 120*b* by elastic force of a spring (not illustrated).

In FIG. 1, a first roller pair drive motor 62 drives the first lower roller 115*b*. A second roller pair drive motor 63 drives the second upper roller 114*a*.

Between the first roller pair 115 and the registration roller pair 120, upper guides 66 and 67 and a lower guide 68 for guiding a conveyed sheet are disposed. In a portion between the upper guides 66 and 67 and the lower guide 68, a space is partially extended to allow a loop of the sheet to be formed by the sheet pressed against the nip portion of the registration roller pair 120.

A separation mechanism 140 is used to set a nip between the second upper roller 114*a* and the second lower roller 114*b* of the second roller pair 114 to a separated state. The separation mechanism 140 is configured to separate the second lower roller 114*b* from the second upper roller 114*a* of the second roller pair 114. The separation of the second lower roller 114*b* from the second upper roller 114*a* reduces the nip force applied to the sheet at the nip portion to zero.

The separation mechanism 140 includes a second lower roller separation motor 145, an input gear 144, a shaft 143, and separation levers 142*f* and 142*r*. An output gear of the second lower roller separation motor 145 engages with the input gear 144. The input gear 144 is fixed to an end portion of the shaft 143. The separation levers 142*f* and 142*r* fixed to the shaft 143 contact the shaft of the first lower roller 115*b* from the upper side.

With the mechanism, when the second lower roller separation motor 145 illustrated in FIG. 1 is rotated in a clockwise direction by a predetermined amount, the shaft 143 is driven to rotate, and the separation levers 142*f* and 142*r* are rotated in a counterclockwise direction. The movement lifts the second lower roller 114*b* against the elastic force of the spring (not illustrated), and separates the second lower roller 114*b* from the second upper roller 114*a*. When the second lower roller separation motor 145 is rotated in the counterclockwise direction, the separation levers 142*f* and 142*r* are rotated in the clockwise direction via the shaft 143. Then, by the elastic force of the spring (not illustrated), the second lower roller 114*b* is pressed against the second upper roller 114*a*.

Figure 7:
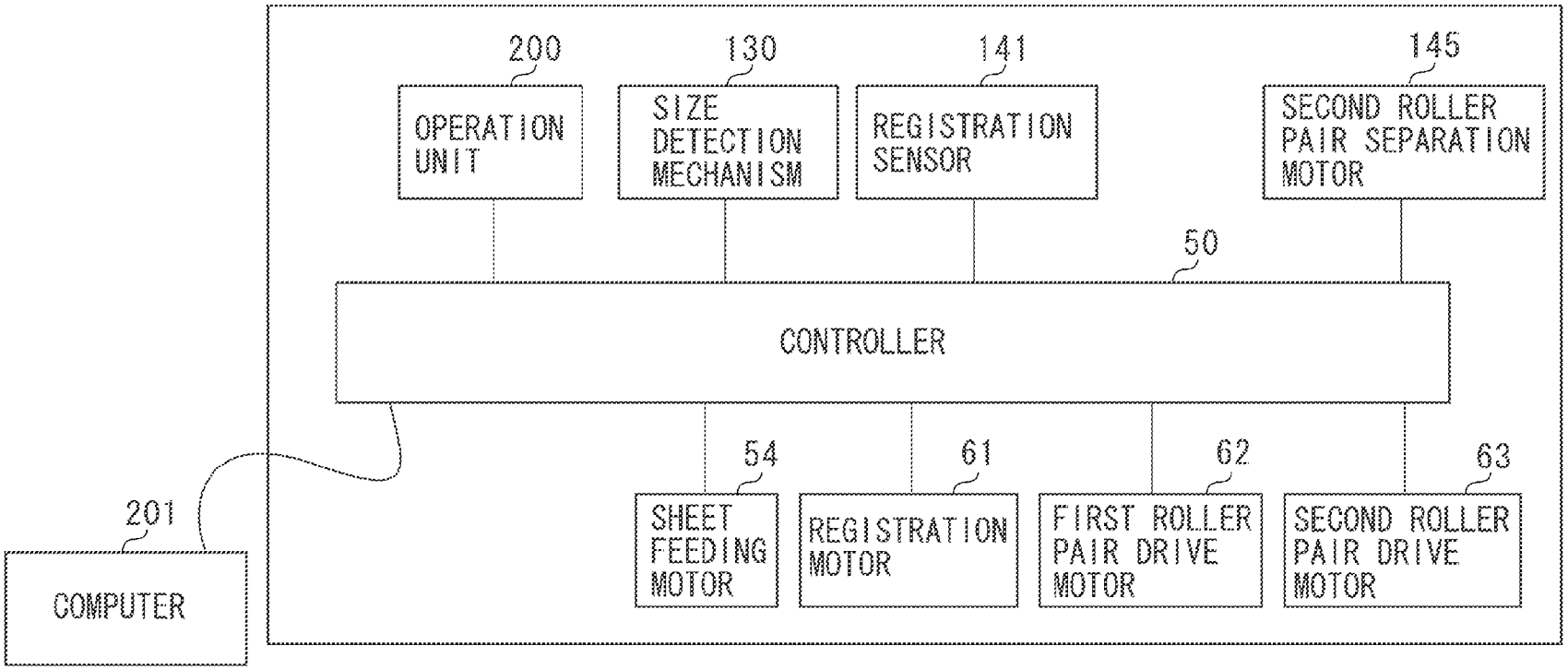
FIG. 7 is a block diagram illustrating an image forming apparatus according to the first exemplary embodiment.

As illustrated in the block diagram in FIG. 7, the controller 50 that serves as a control unit is connected to an operation unit 200 and the size detection mechanism 130 in the image forming apparatus. The controller 50 is also connected to the registration sensor 141, the second lower roller separation motor 145, a registration motor 61, a sheet feeding motor 54, the first roller pair drive motor 62, and the second roller pair drive motor 63. The sheet feeding motor 54 drives the sheet feeding rollers. The registration motor 61 drives the registration roller pair 120.

In the exemplary embodiment, the controller 50 determines whether to set the nip portion of the second roller pair to a separated state based on the type of the sheet, the size of the sheet, the basis weight of the sheet, and the like (hereinafter, referred to as sheet information). Specifically, the controller 50 determines whether to set the second lower roller 114*b* to the separated state based on sheet information specified by a user or sheet information detected by the size detection mechanism 130, or a combination of the information.

For example, the table illustrated in FIG. 8 shows an example of the sheet information (sheet width, and sheet basis weight) and the determination whether to separate the second lower roller 114*b* from the second upper roller 114*a*. The width of the sheet indicates the length in the direction perpendicular to the sheet conveyance direction.

As illustrated in FIG. 8, in a case where the basis weight of the sheet is in the range from 52 g/m$^2$ to 180 g/m$^2$ inclusive, the second roller pair 114 is set to the separated state, irrespective of the width of the sheet.

In a case where the basis weight of the sheet is in the range from 181 g/m$^2$ to 256 g/m$^2$ inclusive, similarly, the second roller pair 114 is set to the separated state, irrespective of the width of the sheet.

In a case where the basis weight of the sheet is in the range from 257 g/m$^2$ to 325 g/m$^2$ inclusive, the execution of the separation of the second roller pair 114 differs depending on the width of the sheet. In a case where the width of the sheet is in the range from 100 mm to 209 mm inclusive, the second roller pair 114 is set to the separated state. In a case where the width of the sheet is in the range from 210 mm to 330.2 mm inclusive, the second roller pair 114 is not set to the separated state.

As described above, in the exemplary embodiment, using the width of the sheet and the basis weight of the sheet as the sheet information, the controller 50 determines whether to set second roller pair 114 to the separated state based on the sheet information. The exemplary embodiment is not limited to the above-mentioned specific values, values for determining whether to set the second roller pair 114 to the separated state can be employed depending on the characteristics of the apparatus or the like. Furthermore, the second roller pair 114 can be uniformly set to the separated state depending on the characteristics of the apparatus or the like. The sheet information includes at least one of the type of sheet, the size of sheet, and the basis weight of sheet.

There will be described the reasons for determining, based on the sheet information according to the exemplary embodiment, whether to set the second roller pair 114 to the separated state to execute the separation.

The first roller pair 115 conveys a sheet, and allows the sheet to come in contact with the nip portion of the registration roller pair 120 being stopped. When a loop of the sheet is formed to correct a skew of the sheet, a force to return to the original state (hereinafter, referred to as loop reaction force) acts on the sheet having the formed loop. Depending on the basis weight of the sheet and the width of the sheet, the loop reaction force varies. The loop reaction force tends to increase with increasing basis weight of the sheet, and the loop reaction force tends to increase with increasing width of the sheet. An loop reaction force exceeding the nip force of the first roller pair 115 causes the sheet to slip at the first roller pair 115, and the skew of the sheet is corrected while the sheet is turning around.

If the loop reaction force of the sheet is large and the force exceeds the nip force of the first roller pair 115, the sheet slips at the first roller pair 115 and consequently, a loop of a desired size is not formed. As a result, the sheet turns and the skew of the sheet is corrected.

If the second roller pair 114 is not set to the separated state, the sheet is nipped by the first roller pair 115, and also by the second roller pair 114 disposed upstream of the first roller pair 115. The nip force by the second roller pair 114 applied to the upstream side of the sheet may affect the turning performance of the sheet. This decreases the performance of the sheet skew correction.

The negative effect on the sheet turning performance especially affects the skew correction for a sheet having relatively a large loop reaction force. The loop reaction force is the force of the sheet having a loop to return to its original state, and if the basis weight or the width of the sheet is large, the loop reaction force of the sheet becomes large. In the exemplary embodiment, the sheets having a relatively large loop reaction force include sheets having a basis weight in the range from 181 g/m$^2$ to 256 g/m$^2$ inclusive and having a width in the range from 210 mm to 330.2 mm inclusive, and sheets having a basis weight in the range from 257 g/m$^2$ to 325 g/m$^2$ inclusive and having a width in the range from 100 mm to 209 mm inclusive.

The sheet having a relatively large loop reaction force slips at the first roller pair 115 before a large loop necessary for the skew correction, which allows the leading edge of the sheet to be straight, is formed between the first roller pair 115 and the registration roller pair 120.

If the sheet is nipped with the second roller pair 114 disposed upstream of the first roller pair 115 when a skew is to be corrected while the sheet slips at the first roller pair 115, it becomes difficult for the sheet to turn around.

Consequently, in the exemplary embodiment, when the sheet having a relatively large loop reaction force is used, the second roller pair 114 is set to the separated state to facilitate the turning of the sheet at the upstream side. The mechanism allows, in addition to the loop between the first roller pair 115 and the registration roller pair 120, the leading edge of the sheet to become parallel to the shaft line of the registration roller pair 120 by the turning of the sheet. As described above, setting the second roller pair 114 to the separated state to prevent the negative effect on the turning of the sheet can increase the skew correction performance for the sheet having a relatively large loop reaction force.

Meanwhile, in a case of a sheet having a very large loop reaction force, it is desirable to nip and convey the sheet without setting the second roller pair 114 to the separated state. In the exemplary embodiment, the sheets having a very large loop reaction force include sheets having a basis weight in the range from 257 g/m$^2$ to 325 g/m$^2$ inclusive and having a width in the range of 210 mm to 330.2 mm inclusive.

In correcting a skew of the sheet having a very large loop reaction force, if the second roller pair 114 presses and contacts the sheet, the turning performance of the sheet can be lost. In the case of the sheet having a very large loop reaction force, however, if the sheet is conveyed only with the first roller pair 115, the sheet may not be pressed to contact the nip portion of the registration roller pair 120. In such a case, the skew of the sheet may not be corrected. Therefore, for the sheet having a very large loop reaction force, the sheet is to be nipped with both the first roller pair 115 and the second roller pair 114 without setting the second roller pair 114 to the separated state, and conveyed toward the nip portion of the registration roller pair 120.

In a case of a sheet having a relatively small loop reaction force, the sheet does not slip at the first roller pair 115. Therefore, a loop necessary for the skew correction can be formed between the first roller pair 115 and the registration roller pair 120. Consequently, it is not always necessary to set the second roller pair 114 to the separated state to improve the accuracy of the skew correction. In the exemplary embodiment, the sheets having a relatively small loop reaction force include sheets having a basis weight in the range from 52 g/m$^2$ to 180 g/m$^2$ inclusive, and sheets having a basis weight in the range from 181 g/m$^2$ to 256 g/m$^2$ inclusive and having a width in the range from 100 mm to 209 mm inclusive.

In the first exemplary embodiment made in view of the above problems, based on the sheet information, the second roller pair 114 is set to the separated state or to the press-contact state. In other words, in the first exemplary embodiment, whether to set the second roller pair 114 to the separated state is determined based on the information about the basis weight and width of a conveyed sheet (information about the loop reaction force). The mechanism can increase the skew correction performance for various types of sheet.

The operation for correcting a skew of a sheet is described with reference to the skew correction apparatus 116.

Figure 2A:
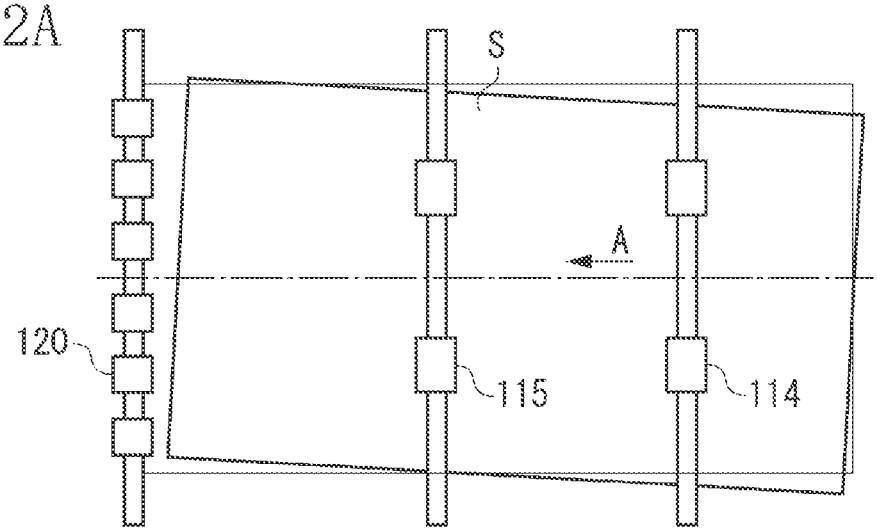
FIGS. 2A, 2B and 2C illustrate a sheet skew correction operation according to the first exemplary embodiment.
Figure 2B:
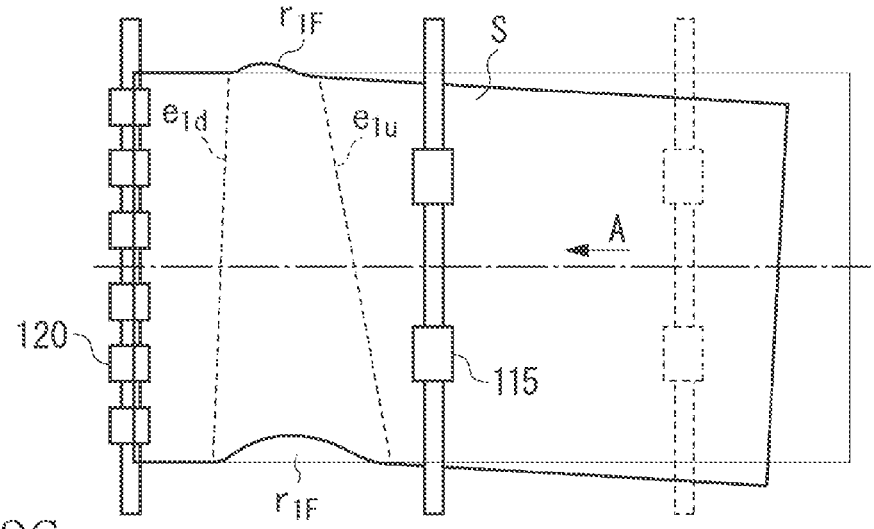
Figure 2C:
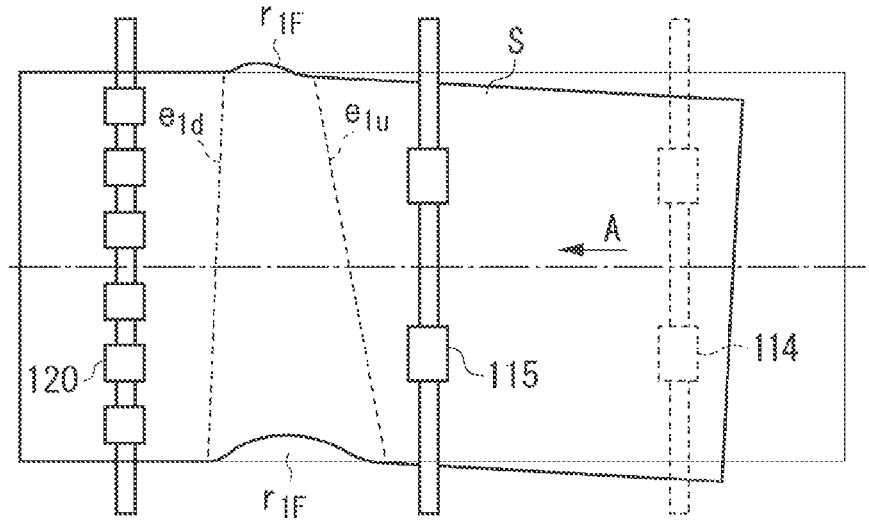
Figures 3A, 3B, 3C:
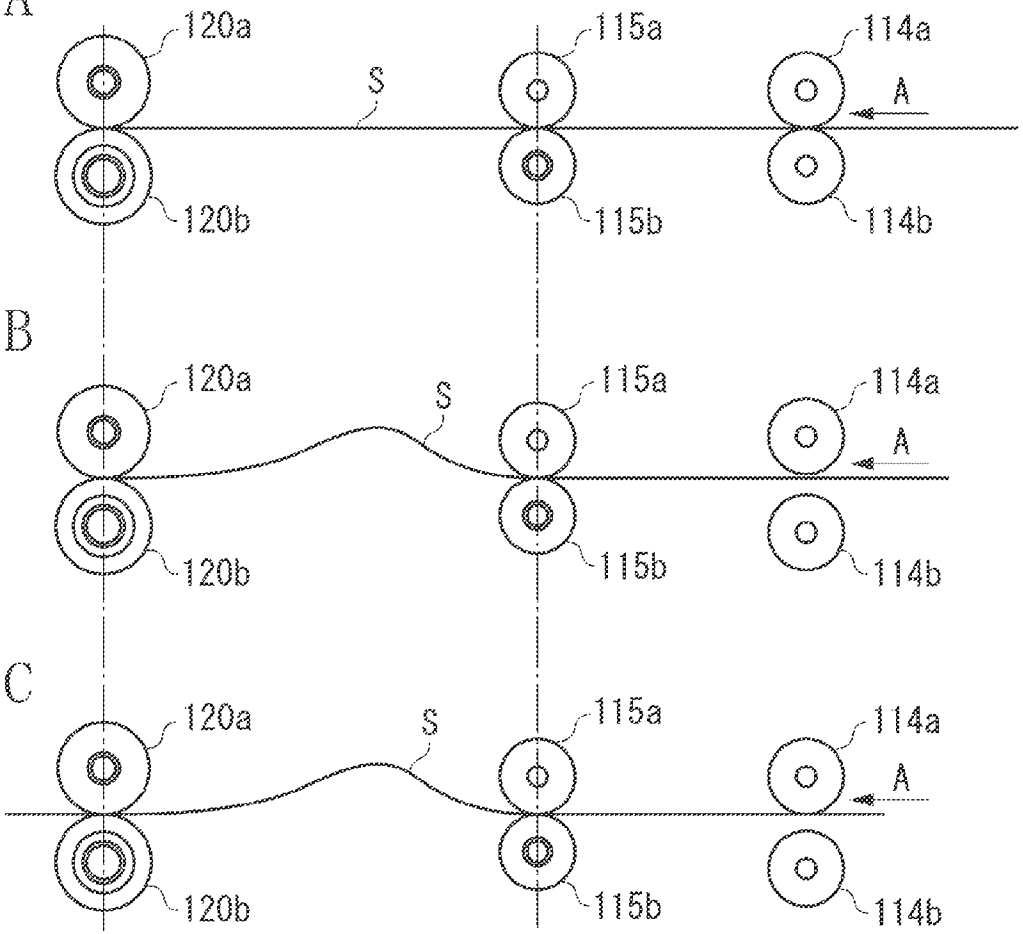
FIGS. 3A, 3B and 3C illustrate the sheet skew correction operation according to the first exemplary embodiment.

With reference to FIGS. 2A, 2B, 2C, 3A, 3B, and 3C, the operation of the skew correction apparatus 116 for a sheet having relatively a small basis weight and width, and a relatively small loop reaction force is described. FIGS. 2A, 2B, and 2C illustrate the skew correction apparatus 116 viewed from above. FIGS. 3A, 3B, and 3C are side views. FIGS. 2A, 2B, and 2C correspond to FIGS. 3A, 3B, and 3C, respectively.

A skew correction operation to be performed when the sheet is skewed to the left side with respect to the conveyance direction A as illustrated in FIG. 2A is described. From the state illustrated in FIG. 2A, the left-side leading edge of the sheet being conveyed in the conveyance direction A comes in contact with the nip portion of the registration roller pair 120. At this moment, the rotation operation of the registration roller pair 120 is stopped. Although it is not always necessary to set the second roller pair 114 to the separated state to increase the accuracy of the skew correction, in the exemplary embodiment, the control is performed such that the second roller pair 114 is set to the separated state before the leading edge of the sheet contacts the nip portion of the registration roller pair 120.

The first roller pair 115 is further rotated and the sheet is conveyed in the conveyance direction A. Then, as illustrated in FIGS. 2B and 3B, the entire leading edge of the sheet in the conveyance direction A contacts the nip portion of the registration roller pair 120. In this operation, between the registration roller pair 120 and the first roller pair 115, a loop of the sheet is formed.

In a case of a sheet having a relatively small loop reaction force, the loop reaction force of the sheet having the loop does not exceed the nip force of the first roller pair 115. Consequently, the sheet does not slip at the first roller pair 115. As a result, as illustrated in FIGS. 2B and 3B, a relatively large sheet forms a relatively large loop. Between the registration roller pair 120 and the first roller pair 115, a large loop is formed and the leading edge of the sheet is made straight.

Then, the registration roller pair 120 is rotated and as illustrated in FIGS. 2C and 3C, the sheet S is conveyed in the state where the skew is corrected.

The loop of the sheet formed to correct the sheet skew is appropriately set based on the sheet information. The controller 50 can determine an optimal amount of loop based on the sheet information specified by the user with the operation unit 200, the sheet information detected with the size detection mechanism 130, or a combination of the information.

Figure 4A:
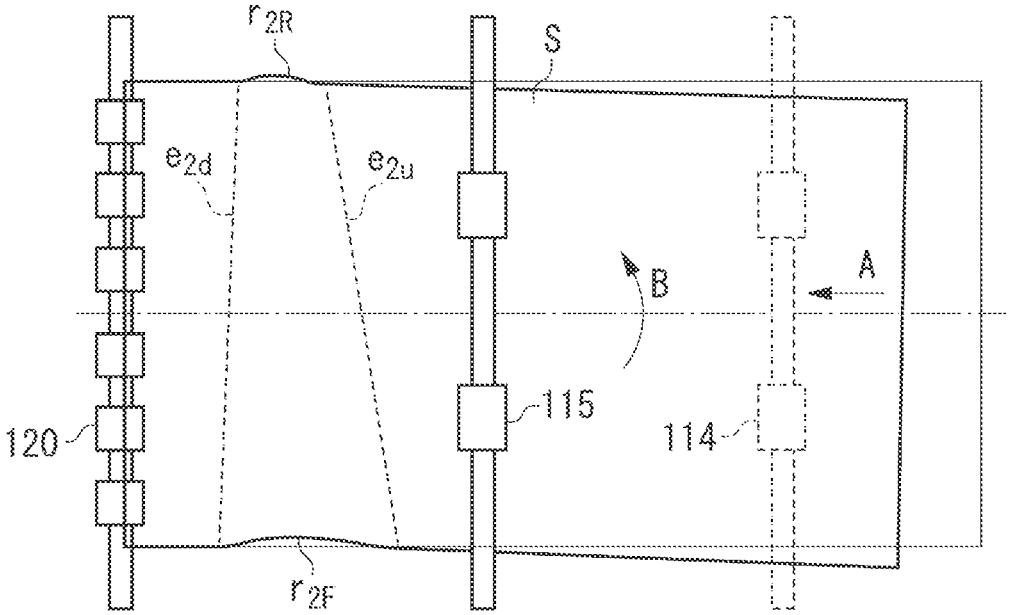
FIGS. 4A and 4B illustrate the sheet skew correction operation according to the first exemplary embodiment.
Figure 4B:
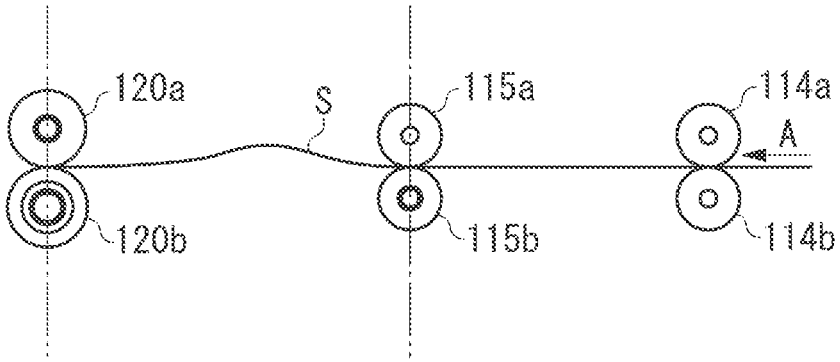

With reference to FIGS. 4A and 4B, the operation of the skew correction apparatus 116 for a sheet having relatively a large basis weight and width, and a relatively large loop reaction force is described. Descriptions similar to those of the sheet having a relatively small loop reaction force will be omitted.

In the correction of a skew of the sheet having a relatively large loop reaction force, the second roller pair 114 is similarly set to the separated state before the leading edge of the sheet contacts the nip portion of the registration roller pair 120.

In a case of the sheet having a relatively large loop reaction force, the loop reaction force of the sheet having the loop exceeds the nip force of the first roller pair 115. Consequently, the sheet slips at the first roller pair 115.

As illustrated in FIGS. 4A and 4B, while the sheet turns in the arrow-B direction, the skew is corrected. In other words, in addition to the loop formation between the first roller pair 115 and the registration roller pair 120, the turning of the sheet in the arrow-B direction allows the leading edge of the sheet to become parallel to the shaft line of the registration roller pair 120. Then, the registration roller pair 120 is rotated and the sheet S is conveyed in the state where the skew is corrected.

Figure 5A:
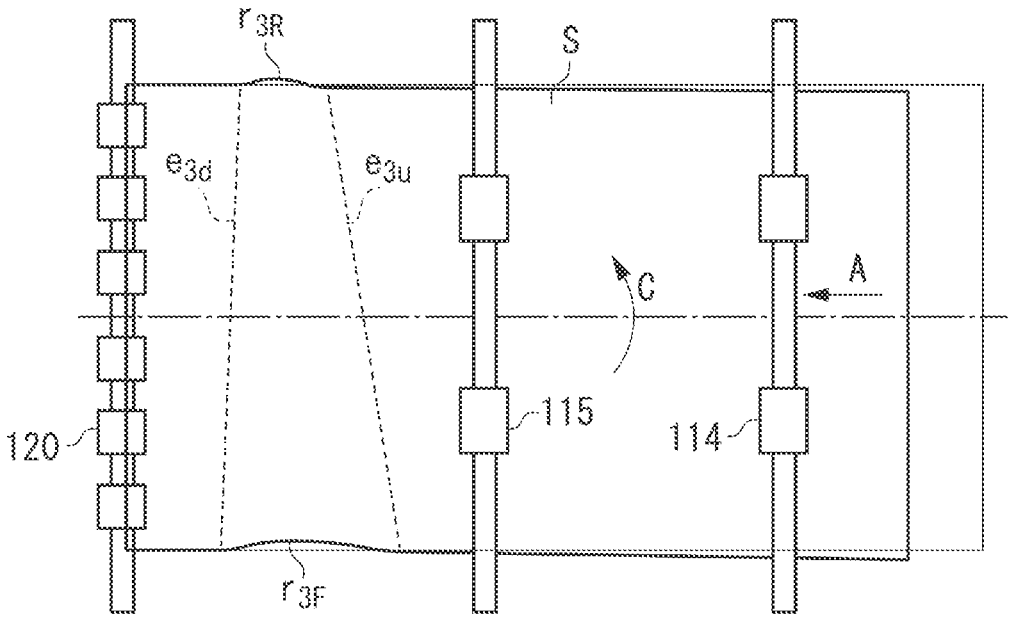
FIGS. 5A and 5B illustrate the sheet skew correction operation according to the first exemplary embodiment.
Figure 5B:
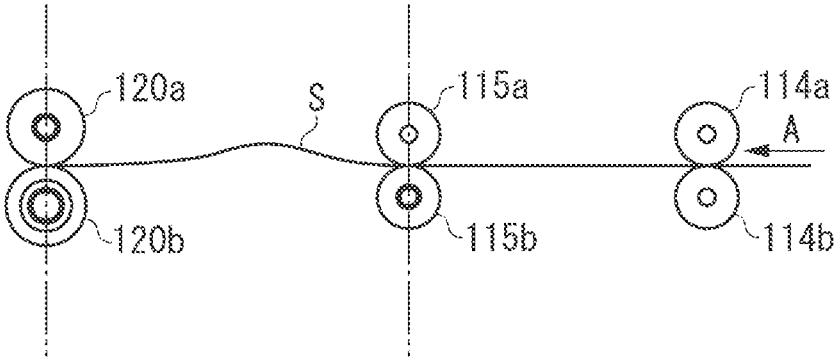

With reference to FIGS. 5A and 5B, the operation of the skew correction apparatus 116 for a sheet having very large basis weight and width, and a very large loop reaction force is described. Descriptions similar to those of the sheet having a relatively small loop reaction force will be omitted.

In the correction of a skew of the sheet having a very large loop reaction force, the leading edge of the sheet contacts the nip portion of the registration roller pair 120 in a state where the second roller pair 114 is not in the separated state but in a press-contact state.

In the case of the sheet having a very large loop reaction force, similarly, the loop reaction force of the sheet having the loop exceeds the nip force of the first roller pair 115. Consequently, the sheet slips at the first roller pair 115. As illustrated in FIGS. 5A and 5B, while the sheet turns in the arrow-C direction, the skew is corrected.

As described above, in the exemplary embodiment, whether to set the second roller pair 114 to the separated state is determined based on the sheet information about the basis weight of the sheet and the width of the sheet, and the skew of the sheet is corrected. As illustrated in FIGS. 2A, 2B, and 2C to FIGS. 5A and 5B, the occurrence of slip of the sheet at the first roller pair 115 tends to increase with increasing loop reaction force. Consequently, the amount of loop formed by the sheet also decreases.

Figure 6:
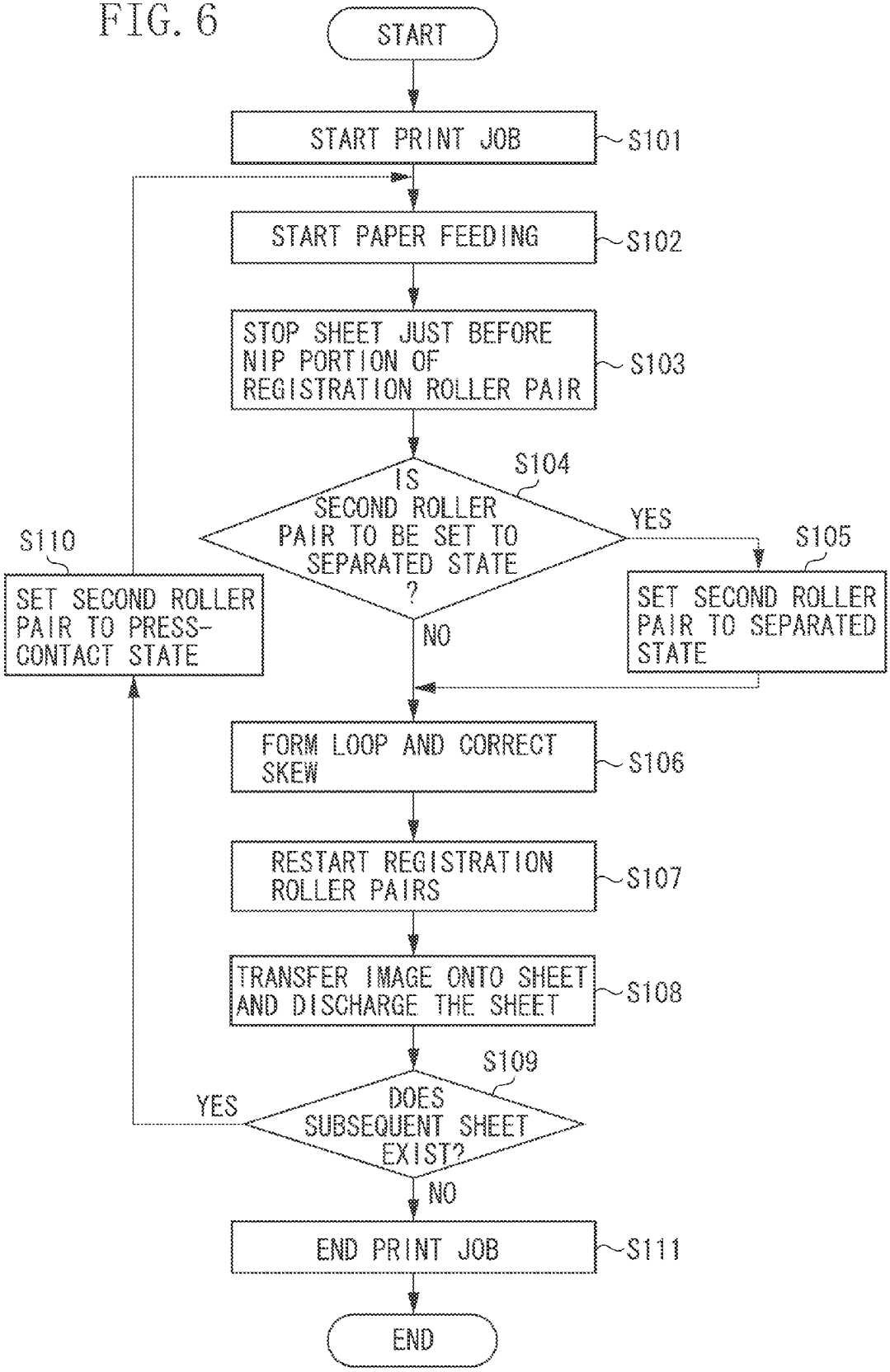
FIG. 6 is a flowchart illustrating the skew correction operation performed in the skew correction apparatus according to the first exemplary embodiment.

With reference to FIG. 6, the flow of the sheet skew correction operation performed by the skew correction apparatus 116 according to the first exemplary embodiment is described.

In step S101, a user executes a print job from the operation unit 200 of the image forming apparatus or the computer 201 connected directly or via a network to the image forming apparatus. In this operation, the user can specify the number of sheets to be printed and the sheet information of the sheet to be used. Further, with the size detection mechanism 130, the user can detect the sheet information.

In step S102, for the execution of the print job, the sheet fed from the sheet feeding deck 112 with the sheet feeding rollers is conveyed toward the registration sensor 141 with the second roller pair 114 and the first roller pair 115. In step S103, the registration sensor 141 detects the sheet being conveyed with the second roller pair 114 and the first roller pair 115, and the first roller pair 115 and the second roller pair 114 stop the rotation to stop the sheet just before the nip portion of the registration roller pair 120. The operation is performed to allow the leading edge of the sheet to come in contact with the nip portion of the registration roller pair 120 at a low speed, to prevent the leading edge of the sheet from being pushed into the nip portion of the registration roller pair 120 and to reduce the sound produced when the sheet contacts the nip portion.

The controller 50 stores a table like the table illustrated in FIG. 8 in advance, the table containing the sheet information and the corresponding information whether to set the second roller pair 114 to the separated state. In step S104, the controller 50 refers to the table, and determines whether to set the second roller pair 114 to the separated state.

If the controller 50 determines that the second roller pair 114 is to be set to the separated state (YES in step S104), then in step S105, the controller 50 drives the second lower roller separation motor 145, while the sheet is being stopped, to separate the second lower roller 114*b* from the second upper roller 114*a*. If the controller 50 determines that the second roller pair 114 is not to be set to the separated state (NO in step S104), the controller 50 does not set the second roller pair 114 to the separated state.

In step S106, after a predetermined time period has passed, the first roller pair 115 and the second roller pair 114 start the rotation and the skew correction operation is performed. In other words, in a state where the leading edge of the sheet contacts the nip portion of the registration roller pair 120, the first roller pair 115 and the second roller pair 114 are rotated by a predetermined amount to form a loop of the sheet to correct the skew of the sheet.

In step S107, if the second roller pair 114 is set to the separated state, the registration roller pair 120 and the first roller pair 115 are simultaneously restarted, and the sheet is conveyed to a downstream secondary transfer unit while maintaining the state where the skew is corrected. If the second roller pair 114 is not set to the separated state, the registration roller pair 120, the first roller pair 115, and the second roller pair 114 are simultaneously restarted to convey the sheet.

In step S108, for the sheet conveyed to the secondary transfer unit, the image transfer operation onto the sheet and the sheet discharge operation are performed. In step S109, the controller 50 determines whether a subsequent sheet exists. If the controller 50 determines that a subsequent sheet exists, and the second roller pair 114 is set to the separated state (YES in step S109), then in step S110, the controller 50 drives the second lower roller separation motor 145 again to complete the press-contact operation before the subsequent sheet reaches the second roller pair 114 to convey the subsequent sheet with the second roller pair 114. If a subsequent sheet does not exist (NO in step S109), the controller 50 ends the print job.

As described above, in the first exemplary embodiment, the second roller pair 114 is set to the separated state or to the press-contact state based on the sheet information. Consequently, the sheet skew correction performance can be increased.

In the above description, the control for stopping the sheet just before the nip portion of the registration roller pair has been described. It is not always necessary for the sheet to be stopped just before the nip portion of the registration roller pair. In such a case, effects similar to those in the first exemplary embodiment can be achieved by setting the first roller pair 115 to a separated state before a loop of the sheet is formed.

In the above description, the second roller pair 114 is set to the separated state before the rotation of the first roller pair 115 being stopped is restarted to allow the leading edge of the sheet to contact the registration roller pair 120. However, the timing for setting the second roller pair 114 to the separated state can be set at any time before the skew of the sheet is corrected and before the rotation of the registration roller pair 120 being stopped is restarted. For example, after the rotation of the registration roller pair 120, being stopped is restarted to allow the leading edge of the sheet to contact the registration roller pair 120, the second roller pair 114 can be set to the separated state while the sheet is being conveyed with the first roller pair 115 to grow the loop of the sheet. To facilitate the turning of the sheet, as described in the first exemplary embodiment, it is desirable that the second roller pair 114 is set to separated state in an early stage, that is, by the time the leading edge of the sheet contacts the nip portion of the registration roller pair to start the formation of a loop.

Figure 10:
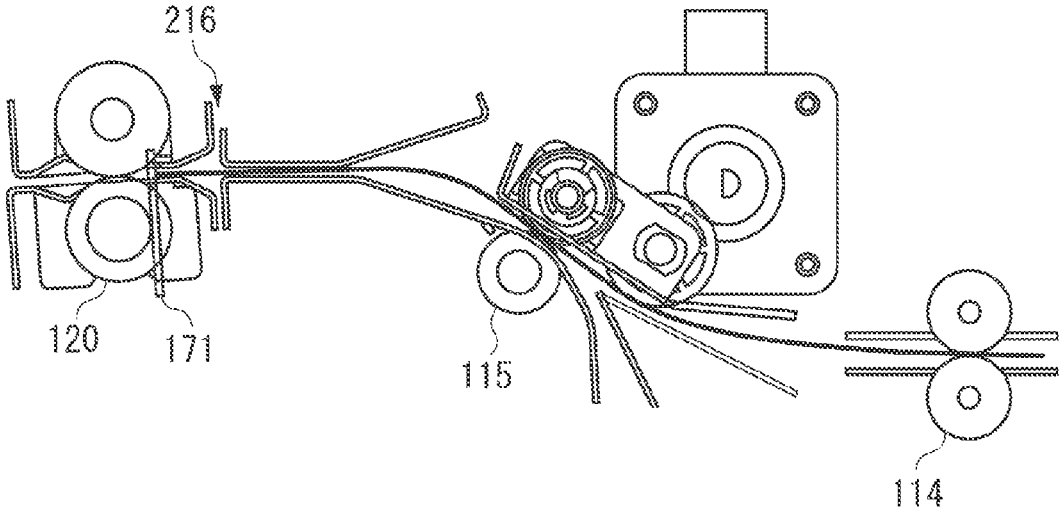
FIG. 10 illustrates a skew correction apparatus according to a second exemplary embodiment.

A second exemplary embodiment will now be described. FIG. 10 is a side view of a skew correction apparatus 216 according to the second exemplary embodiment. The second exemplary embodiment differs from the first exemplary embodiment only in a point that the skew correction apparatus 216 has a shutter member 171 that serves as a contact unit. Other structures and operations are similar to those in the first exemplary embodiment, and therefore, their descriptions are omitted.

In the first exemplary embodiment, a skew is corrected by pressing the leading edge of the sheet against the nip portion of the stopped registration roller pair. In the second exemplary embodiment, the leading edge of the sheet is pressed against the planar shutter member 171 to perform the skew correction.

In the second exemplary embodiment, the shutter member 171 is disposed downstream of the first roller pair 115 and upstream of the registration roller pair 120. The shutter member 171 is protruded to the conveyance path and retracted from the conveyance path by a drive unit (not illustrated). When the shutter member 171 is protruded to the conveyance path, the leading edge of the conveyed sheet contacts the shutter member 171, and the skew of the sheet is corrected. Then, the shutter member 171 is retracted from the conveyance path, and the sheet is conveyed to the registration roller pair 120. The sheet is further conveyed to the image forming unit. Different from the first exemplary embodiment, the registration roller pair 120 only coveys the conveyed sheet to the image forming unit, and the registration roller pair 120 is not required to stop to form a loop of the sheet.

The shutter member can be disposed downstream of the registration roller pair 120. In such a case, a separation mechanism for setting the registration roller pair 120 to a separated state or a contact state is to be provided. In other words, in pressing the leading edge of the sheet against the shutter member 171, the registration roller pair 120 is to be set to the separated state. After a loop of the sheet is formed and the skew correction is completed, the registration roller pair 120 is to be set to a press-contact state and nip the sheet. After the shutter member 171 is retracted, the rotation of the registration roller pair 120 is started to convey the sheet to the image forming unit.

In the above-described exemplary embodiments, the amount of loop of the sheet to be formed is determined based on the sheet information. However, these embodiments are not limited to this mechanism. For example, in an image forming apparatus in which an available range of sheet size or basis weight is narrow, the amount of loop can be uniformly set without referring to the sheet information, to correct the skew of the sheet by the skew correction unit.

In the above-described exemplary embodiments, the control unit determines whether to set the second roller pair 114 to the separated state based on the information containing both the basis weight and width of the sheet as the sheet information. However, these embodiments are not limited to this example. For example, the control unit can determine whether to set the second roller pair to the separated state based on only the basis weight of the sheet. If the basis weight of the sheet is equal to or smaller than a predetermined value, the second roller pair can be set to the separated state, and if the basis weight of the sheet is larger than the predetermined value, the second roller pair can be set to the press-contact state.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-088471 filed Apr. 9, 2012, which is hereby incorporated by reference herein in its entirety.

What is claimed is:

1. A skew correction apparatus comprising:

a first roller pair configured to nip a sheet to convey the sheet;

a second roller pair provided upstream of the first roller pair in a sheet conveyance direction and configured to nip the sheet to convey the sheet wherein the second roller pair comprises a second roller pair shaft;

a stopping portion provided downstream of the first roller pair in the sheet conveyance direction and configured to stop a leading edge of the sheet conveyed by the first roller pair to correct a skew of the leading edge of the sheet;

a separation mechanism configured to set the second roller pair to a separated state; and a control unit configured to stop the rotation of the first roller pair and the second roller pair such that the sheet conveyed by the first roller pair and the second roller pair is stopped at a predetermined position, wherein a leading edge of the sheet stopped at the predetermined position is displaced from the stopping portion and is upstream of the stopping portion in the sheet conveyance direction, and to set the second roller pair to the separated state in a state where the sheet being nipped by the first roller pair is stopped at the predetermined position, and after the second roller pair is set to the separated state, to restart the rotation of the first roller pair so as to convey the sheet from the predetermined position in the sheet conveyance direction to make the leading edge of the sheet in contact with the stopping portion for correcting the skew of the leading edge of the sheet in a state where the second roller pair is in the separated state, wherein the axis of the second roller pair shaft remains fixed during skew correction.

2. The skew correction apparatus according to claim 1, wherein the control unit obtains sheet information of the conveyed sheet and determines, based on the sheet information, whether to set the second roller pair to the separated state with the separation mechanism.

3. The skew correction apparatus according to claim 2, wherein the control unit determines whether to set the second roller pair to the separated state based on first sheet information input by a user, second sheet information detected by a size detection mechanism configured to detect a size of the sheet, or a combination of the first sheet information and the second sheet information.

4. An image forming apparatus comprising:

the skew correction apparatus according to claim 1; and an image forming unit configured to form an image on a sheet whose skew has been corrected with the skew correction apparatus.

5. The skew correction apparatus according to claim 1, wherein the separation mechanism sets the second roller pair to the separated state before the leading edge of the sheet is stopped by the stopping portion.

6. The skew correction apparatus according to claim 1, further comprising:

a detection unit configured to detect the conveyed sheet at a detection position downstream of the first roller pair in the sheet conveyance direction and upstream of the contact portion in the sheet conveyance direction, wherein the control unit stops the rotation of the first roller pair and the second roller pair based on a detection result of the detection unit, such that the leading edge of the sheet conveyed by the first roller pair and the second roller pair stops at the position upstream of the contact portion in the sheet conveyance direction.

7. The skew correction apparatus according to claim 1, wherein the stopping portion includes a nip portion of registration rollers.

8. The skew correction apparatus according to claim 1, wherein the stopping portion includes a shutter member protruded to a sheet conveyance path for the sheet.

* * * * *